US010361472B2

(12) United States Patent
Deshpande

(10) Patent No.: US 10,361,472 B2
(45) Date of Patent: Jul. 23, 2019

(54) ANTENNA FOR CUBESAT PLATFORMS

(71) Applicant: The United States of America as represented by the Administrator of NASA, Washington, DC (US)

(72) Inventor: Manohar Deshpande, Odenton, MD (US)

(73) Assignee: The United States of America as represented by the Administrator of NASA, Washington, DC (US)

( * ) Notice: Subject to any disclaimer, the term of this patent is extended or adjusted under 35 U.S.C. 154(b) by 7 days.

(21) Appl. No.: 15/709,076

(22) Filed: Sep. 19, 2017

(65) Prior Publication Data

US 2019/0089034 A1 Mar. 21, 2019

(51) Int. Cl.

| | |
|---|---|
| ***H01Q 13/00*** | (2006.01) |
| ***H01P 3/12*** | (2006.01) |
| ***H01P 11/00*** | (2006.01) |
| ***H01P 5/08*** | (2006.01) |
| ***H01R 24/54*** | (2011.01) |
| ***H01Q 13/10*** | (2006.01) |
| ***H01P 1/04*** | (2006.01) |

(52) U.S. Cl.

CPC ..... *H01P 3/12* (2013.01); *H01P 1/04* (2013.01); *H01P 5/082* (2013.01); *H01P 11/003* (2013.01); *H01Q 13/10* (2013.01); *H01R 24/542* (2013.01)

(58) Field of Classification Search

CPC .. H01P 3/12; H01P 1/04; H01P 11/003; H01P 5/082; H01Q 13/10; H01R 24/542

USPC ..... 343/772

See application file for complete search history.

(56) References Cited

U.S. PATENT DOCUMENTS

| | | | | |
|---|---|---|---|---|
| 4,424,430 A * | 1/1984 | Almgren | H05B 6/74 219/749 |
| 5,401,215 A * | 3/1995 | Pfost | A63D 15/006 473/2 |
| 6,480,141 B1 * | 11/2002 | Toth | G01N 22/00 324/639 |
| 9,119,649 B2 * | 9/2015 | van der Weide | A61B 18/1815 |
| 2016/0081747 A1 * | 3/2016 | Thiel | A61B 18/1815 606/33 |

* cited by examiner

*Primary Examiner* — Jean B Jeanglaude

(74) *Attorney, Agent, or Firm* — Christopher O. Edwards; Bryan A. Geurts; Mark P. Dvorscak

(57) ABSTRACT

A Cubesat uses both rail rods, walls, or both as an antenna. Either the rail rods and/or walls may form a rectangular waveguide, and may have one or more slots that allow energy to leak and radiate in a predefined direction in space.

20 Claims, 4 Drawing Sheets

300

ANTENNA FOR CUBESAT PLATFORMS

STATEMENT OF FEDERAL RIGHTS

The invention described herein was made by employees of the United States Government and may be manufactured and used by or for the Government for Government purposes without the payment of any royalties thereon or therefore.

FIELD

The present invention generally relates to CubeSat, and more specifically, an antenna for a CubeSat.

BACKGROUND

Types of antennas that are currently used on CubeSat/SmallSat platforms include monopole/dipole antennas, printed antennas, printed antennas integrated with solar cell, printed antennas printed on the backside of a solar cell. These antennas, however, require packaging and deployment mechanisms. Simply put, these antennas pose a deployment failure risk to a mission, and also, add extra volume and weight to its payload.

SUMMARY

Certain embodiments of the present invention may provide solutions to the problems and needs in the art that have not yet been fully identified, appreciated, or solved by conventional antenna technologies for CubeSat. For example, some embodiments pertain to an antenna for a CubeSat. In an embodiment, an apparatus includes one or more hollow rail rods forming a rectangular tube. The one or hollower rail rods may include one or more slots, allowing energy to leak and radiate in a predefined direction in space.

In another embodiment, an apparatus may include a plurality of walls forming a cube. One or more of the plurality of walls may be hollow, allowing microwave energy to be passed through the one or more of the plurality of walls. Each of the one or more walls may include slots, allowing microwave energy to radiate out into space.

BRIEF DESCRIPTION OF THE DRAWINGS

In order that the advantages of certain embodiments of the invention will be readily understood, a more particular description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE EMBODIMENTS

Some embodiments generally pertain to an embedded antenna within a SmallSat and/or CubeSat without the need of packaging and deployment mechanisms. For purposes of explanation and simplicity, the term "CubeSat" will be used below. In certain embodiments, the embedded antenna may be applicable to communication as well as radar sensors.

A conventional CubeSat generally includes four railing rods at its four corners. The railing rods are made of solid square rods. In the embodiments discussed herein, however, these railing rods are replaced with hollow railing rods. The hollow railing rods have rectangular openings, forming a rectangular tube, for example. These rectangular tubes may be considered as rectangular waveguides, and may act as a transmission line (or an antenna). Although a rectangular tube is discussed in this embodiment; other embodiments may include circular tubes, semi-circular tubes, etc. However, for purposes of explanation, the term "rectangular tubes" may be used below.

Regarding the rectangular tubes, depending on the inner dimension that is selected for the hollow rectangular tubes, the rectangular tubes may carry a radio (RF) energy at a desired frequency. Thus, depending on the frequency desired, the appropriate sized rectangular tube is used.

Since these tubes are in rectangular form and are used on a CubeSat, two of the four sides of the rectangular tubes may be exposed to space. For this reason, two of the four sides of the rectangular tubes may include radiating slots (or slots) to allow RF radiation to emit therefrom. By using four of these rectangular tubes at the four corners of the CubeSat, four antennas may be formed. These antennas may either operate at the same frequency or operate at different frequencies.

Figure 1:
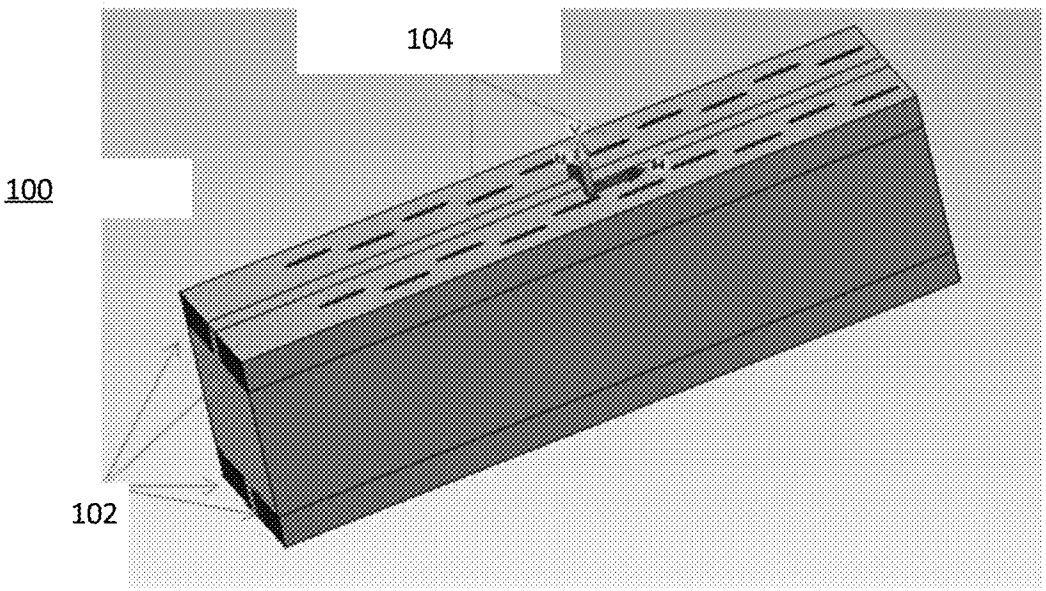
FIG. 1 is a prospective view illustrating a CubeSat, according to an embodiment of the present invention.
Figure 2:
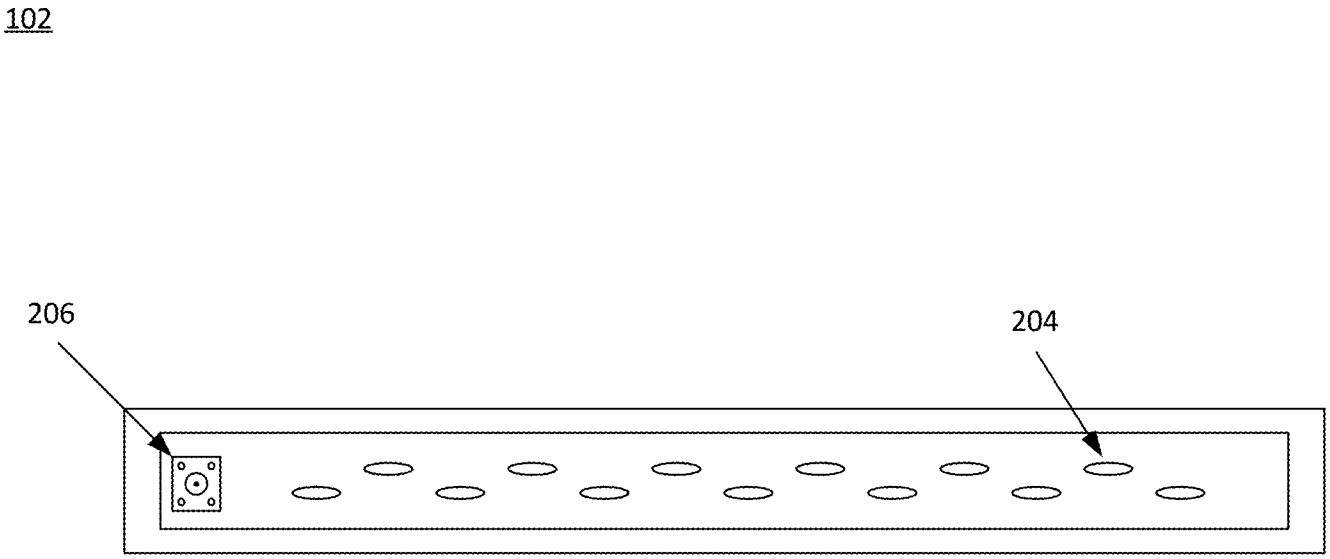
FIG. 2 is a prospective view illustrating antenna for the CubeSat, according to an embodiment of the present invention.

FIG. 1 is a prospective view illustrating a CubeSat 100, according to an embodiment of the present invention. As mentioned above, CubeSat 100 may include four rectangular tubes 102. Each rectangular tube 102 may include slots 104. FIG. 2 is a prospective view illustrating antenna (or rectangular tube) 102 for CubeSat 100, according to an embodiment of the present invention. In this embodiment, rectangular tube 102 may include slots 204 along the length of rectangular tube 102. In certain embodiments, two of the four sides of rectangular tube 102, i.e., the sides that are exposed to space, may include slots 204. The spacing of slots 204 may depend upon the operating frequency that is desired. For example, the slots may be spaced at half a wavelength apart at the desired frequency.

Also, in this embodiment, slots 204 are situated in a zig zag pattern. It should be noted, however, that the pattern in which slots 204 are arranged depend upon the desired radiation pattern, desired beam width, desired side lobe levels. By the arrangement shown in FIG. 2, for example, a desired aperture field distribution can be achieved. Further, radiation patterns may depend upon the aperture distribution. Also, in certain embodiments, slots 204 may be distributed and arranged such that its input VSWR is between approximately 1 and 1.5 over the desired frequency range.

Rectangular tube 102 also includes a coaxial adaptor 206 in this embodiment. To provide some context, a signal from the RF transceiver (e.g., the device that generates the RF communication signal or radar signal) is carried to the antenna by using a coaxial line. With the embodiment shown in FIG. 2, a microwave signal must be transferred from the coaxial line (which is circular in cross section) to rectangular tube 102 (which has rectangular cross section). To make this transfer possible, coaxial adaptor 206 is used to allow the coaxial line to connect to rectangular tube 102. In this embodiment, coaxial adaptor 206 is impedance matched to rectangular tube 102 to avoid reflection losses. Now that the microwave signal is in rectangular tube 102, energy may leak out from slots 204 and radiate in a particular direction away from rectangular tube 102.

Figure 4:
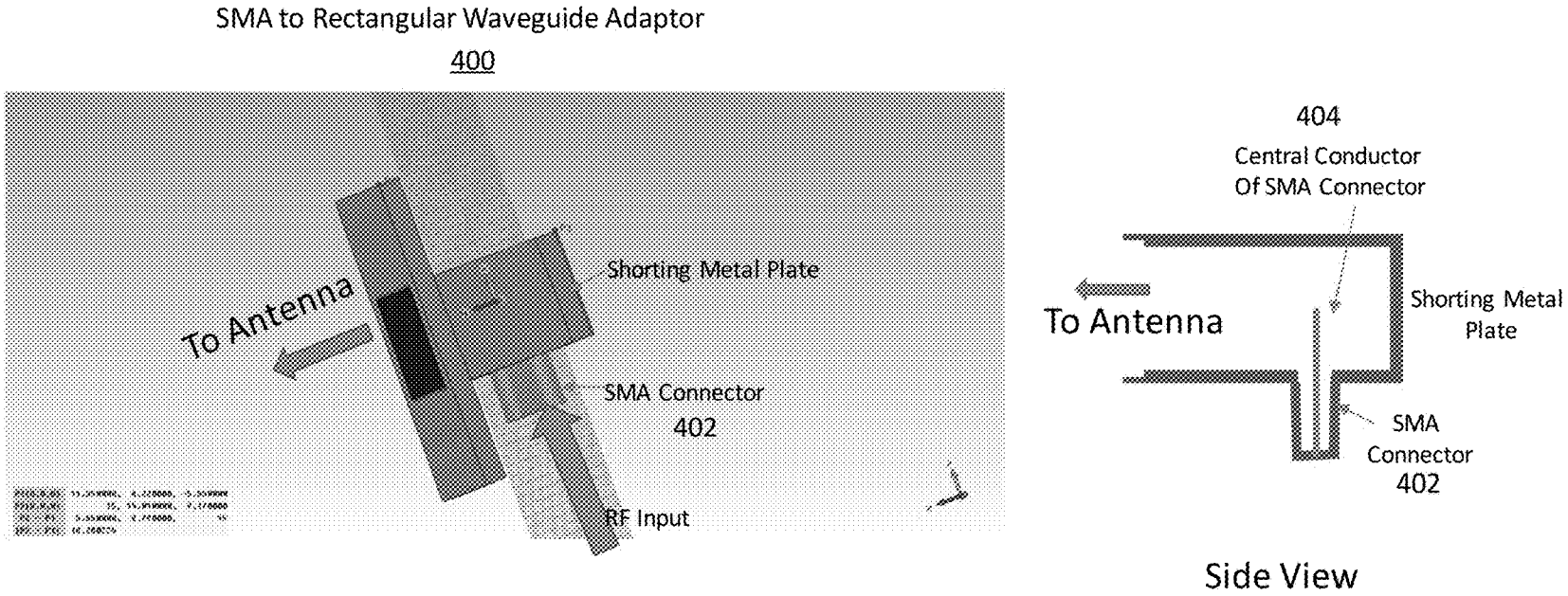
FIG. 4 is a model of a SMA to rectangular waveguide adaptor, according to an embodiment of the present invention

Using commercial available SMA connector, a custom built coaxial to rectangular waveguide adaptor was built and tested. See, for example, FIG. 4, which is a model of a SMA to rectangular waveguide adaptor 400, according to an embodiment of the present invention. Center conductor 404 of SMA connector 402 is further extended into the rectangular waveguide. Length of this extension is appropriately designed for perfect impedance match between SMA connector 402 and the rectangular waveguide.

Figure 3:
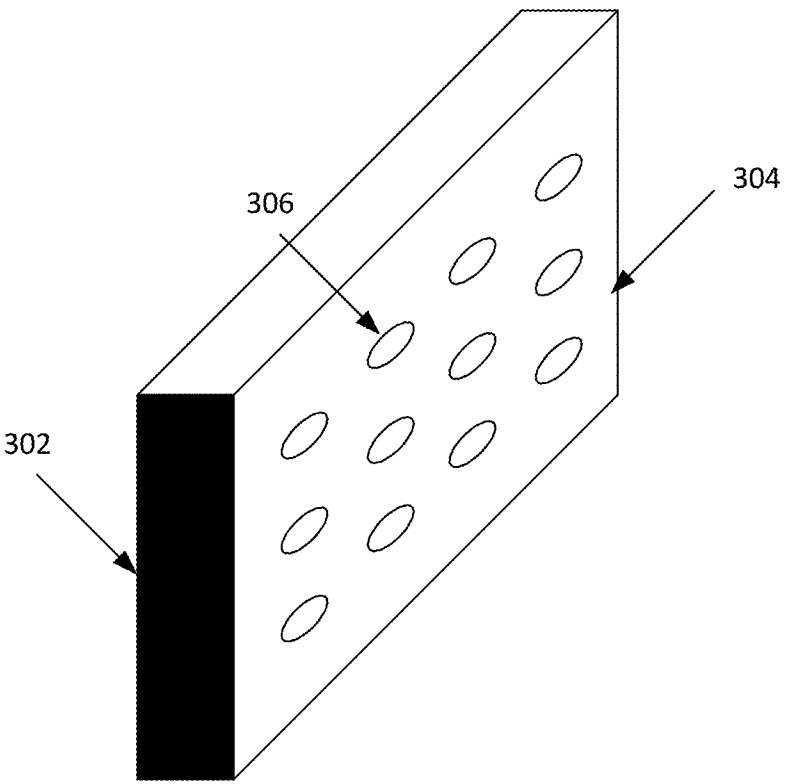
FIG. 3 is a prospective view illustrating an antenna for the CubeSat, according to an embodiment of the present invention.

FIG. 3 is a prospective view illustrating an antenna 300 for the CubeSat, according to an embodiment of the present invention. In some embodiments, the CubeSat wall may be used as an antenna. Since the wall may be in the shape of a rectangle and is hollow, the wall may act as a rectangular waveguide or antenna.

Like FIG. 2, a coaxial adaptor (not shown) may be used to transfer the signal from the coaxial cable into hollow section of wall 302. Section 304 of wall (antenna) 300, which faces Space, may include a plurality of slots 306. In some embodiments, one or more slots may be used depending on the frequency desired. Slots 306 may allow energy to leak out from wall 300, and radiate out to a predefined direction in space. Furthermore, it should be noted that slots 306 are not limited to ovals, and may be in any shape or form to allow energy to radiation out from the CubeSat at the desired frequency.

It should be appreciated that the wall shown in FIG. 3 may have similar functionality to the railing shown in FIGS. 1 and 2. Regardless of whether a wall or a railing is used as the antenna, the concept described herein allows the CubeSat to transmit in 360 degrees, since each wall or railing acts as an antenna. In some embodiments, one or more walls or railings may be used limiting the coverage to a predefined area.

It will be readily understood that the components of various embodiments of the present invention, as generally described and illustrated in the figures herein, may be arranged and designed in a wide variety of different configurations. Thus, the detailed description of the embodiments of the present invention, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, reference throughout this specification to "certain embodiments," "some embodiments," or similar language means that a particular feature, structure, or characteristic described in connection with the embodiment is included in at least one embodiment of the present invention. Thus, appearances of the phrases "in certain embodiments," "in some embodiment," "in other embodiments," or similar language throughout this specification do not necessarily all refer to the same group of embodiments and the described features, structures, or characteristics may be combined in any suitable manner in one or more embodiments.

It should be noted that reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

The invention claimed is:

1. An apparatus, comprising:

one or more railings at each corner of the apparatus, wherein each of the one or more railings form a hollow tube, and comprise at least one slot allowing energy to leak out from the one or more railings and radiate in a particular direction away from the apparatus.

2. The apparatus of claim 1, wherein the one or more railings form a rectangular waveguide configured to act as a transmission line.

3. The apparatus of claim 1, wherein the one or more railings is composed of metal to reduce conductive losses.

4. The apparatus of claim 1, wherein the at least one slot is located on two of four sides of the one or more railings, the two of the four sides being exposed to space.

5. The apparatus of claim 1, wherein each of the one or more railings comprises a plurality of slots spaced apart to achieve a desired frequency.

6. The apparatus of claim 5, wherein the plurality of slots are arranged in a pattern to achieve a desired beam width and desired side lobe levels.

7. The apparatus of claim 1, wherein each of the one or more railings are configured to emit radio frequency (RF) radiation at different frequencies or same frequency.

8. The apparatus of claim 1, wherein the one or more railings comprise a coaxial adaptor configured to connect a coaxial line with a circular cross section to the one or more railings having a rectangular cross section.

9. The apparatus of claim 8, wherein the coaxial adaptor is impedance matched with the one or more railings to avoid reflection losses.

10. The apparatus of claim 8, wherein the coaxial adaptor is configured to transfer the signal from the coaxial line to the one or more railings, allowing the one or more railings to act as a transmission line.

11. An apparatus, comprising:

a plurality of walls forming a cube, wherein each of the plurality of walls are hollow, allowing microwave energy to pass through each of the plurality of walls, wherein each of the plurality of walls comprises a plurality of slots, allowing the microwave energy to radiate out into space.

12. The apparatus of claim 11, wherein each of the plurality of walls form a rectangular waveguide configured to act as a transmission line.

13. The apparatus of claim 11, wherein each of the plurality of walls is composed of metal to reduce conductive losses.

14. The apparatus of claim 11, wherein the plurality of slots are located on a side of the wall exposed to space.

15. The apparatus of claim 11, wherein the plurality of slots are spaced apart to achieve a desired frequency.

16. The apparatus of claim 15, wherein the plurality of slots are arranged in a pattern to achieve a desired beam width and desired side lobe levels.

17. The apparatus of claim 11, wherein each of the plurality of walls are configured to emit radio frequency (RF) radiation at different frequencies or same frequency.

18. The apparatus of claim 11, further comprising:

a plurality of coaxial adaptors connecting a coaxial line with a circular cross section to a corresponding one of the plurality of walls having a rectangular cross section.

19. The apparatus of claim 18, wherein each of the plurality of coaxial adaptors are impedance matched with the corresponding one of the plurality of walls to avoid reflection losses.

20. The apparatus of claim 18, wherein the each of the coaxial adaptors are configured to transfer the signal from the coaxial line to the corresponding one of the plurality of walls, allowing the one or more railings to act as a transmission line.

* * * * *